US005779183A

United States Patent [19]

Aalto et al.

[11] Patent Number: 5,779,183

[45] Date of Patent: Jul. 14, 1998

[54] METHOD AND DEVICE FOR FINISHING THE SURFACE LAYERS OF THE MACHINE REEL THAT IS FORMED DURING REELING OF THE WEB

[75] Inventors: Esa Aalto, Hyvinkää; Markku Kyytsönen, Numminen; Aaron Mannio; Silvo Mikkonen, both of Pärvenpää, all of Finland

[73] Assignee: Valmet Corporation, Helsinki, Finland

[21] Appl. No.: 600,964

[22] PCT Filed: Jun. 9, 1995

[86] PCT No.: PCT/FI95/00334

§ 371 Date: May 28, 1996

§ 102(e) Date: May 28, 1996

[87] PCT Pub. No.: WO95/34495

PCT Pub. Date: Dec. 21, 1995

[30] Foreign Application Priority Data

Jun. 10, 1994 [FI] Finland ..... 942743

[51] Int. Cl.[6] ..... B65H 18/26; B65H 18/14

[52] U.S. Cl. ..... 242/547; 242/541; 242/542.3

[58] Field of Search ..... 242/547, 542.3, 242/541

[56] References Cited

U.S. PATENT DOCUMENTS

| | | | |
|---|---|---|---|
| 4,491,283 | 1/1985 | Pav et al. | 242/547 X |
| 4,832,274 | 5/1989 | Hawkins | 242/541.1 |
| 4,854,517 | 8/1989 | Watanabe et al. | 242/547 X |

FOREIGN PATENT DOCUMENTS

| | | | |
|---|---|---|---|
| 2141006 | 7/1995 | Canada . | |
| 483092 | 4/1992 | European Pat. Off. | 242/542.3 |
| 0664267 | 7/1995 | European Pat. Off. . | |
| 4401804 | 6/1994 | Germany . | |
| 2238527 | 6/1991 | United Kingdom . | |

*Primary Examiner*—John Q. Nguyen

*Attorney, Agent, or Firm*—Steinberg, Raskin & Davidson, P.C.

[57] ABSTRACT

A method and a device for finishing the surface layers of the machine reel (13) that is formed during reeling of the web (P). In the method; a member (20) that presses the web is brought onto the face of the reel (12) that is being completed before the reel (12) that is being completed is transferred to the reel change position. The full reel (12) is transferred to the reel change position so that the member (20) that presses the web during nip-free reeling forms a contact with the web, which contact prevents access of air between the web layers, and follows the full reel (12) during its transfer to the reel change position. During the reeling of the surface layer to be finished, the member (20) that presses the web is shifted apart from the face of the reel (12) that is being completed along such a path (D) of movement that the member (20) that presses the web maintains a contact of the desired extent with the face of the reel (12) that is being completed.

15 Claims, 2 Drawing Sheets

METHOD AND DEVICE FOR FINISHING THE SURFACE LAYERS OF THE MACHINE REEL THAT IS FORMED DURING REELING OF THE WEB

BACKGROUND OF THE INVENTION

The invention concerns a method for finishing the surface layers of the machine reel that is formed during reeling of the web.

The invention also concerns a device for finishing the surface layers of the machine reel that is formed during reeling of the web.

When a full machine reel is separated from the face of the reeling drum, there is no nip contact any longer. Then, air readily penetrates into the machine reel through the gap between the full machine reel and the arriving web, which produces deterioration of the quality of the machine reel. Since air has access between the layers, the layers become slack. Such a drawback of waste layers is relatively extensive and equals up to about 500 metres of web that is reeled. When a full machine reel is stopped, the slack surface layers can move to either side.

At present, attempts are made to prevent the drawbacks described above so that, in connection with change of reel, reeling without a nip is not employed. At present, the properties of the web permit utilization of the web tension. However, the risk of web break in connection with reel change is increased considerably, so that this technique is not optimal either.

SUMMARY

The object of the invention is to provide a method and a device by whose means the drawbacks present in the prior-art solutions are avoided.

The method in accordance with the invention is characterized in that, in the method, (a) a member that presses the web is brought onto the face of the reel that is being completed before the reel that is being completed is transferred to the reel change position, (b) the full reel is transferred to the reel change position so that the member that presses the web during nip-free reeling forms a contact with the web, which contact prevents access of air between the web layers, and follows the full reel during its transfer to the reel change position, and (c) during the reeling of the surface layers to be finished, the member that presses the web is shifted apart from the face of the reel that is being completed along such a path of movement that the member that presses the web maintains a contact of the desired extent with the face of the reel that is being completed.

On the other hand, the device in accordance with the invention is characterized in that the device comprises a member that presses the web and that is brought onto the face of the reel that is being completed before the reel that is completed is transferred to the reel change position, that the member that presses the web is fitted to form a contact with the web, which contact prevents access of air between the web layers, when the full reel is transferred to the reel change position, that said member that presses the web is fitted to follow the full reel during its transfer to the reel change position, and that the member that presses the web is provided with actuators which are fitted to shift the member that presses the web during the reeling of the finishing surface layers apart from the face of the reel that is being completed along such a path of movement that the member that presses the web is fitted to maintain a contact of the desired extent with the face of the reel that is being completed.

In the solution in accordance with the invention, in the final stage of the reeling, nip-free reeling and a member that presses the web are employed. The member that presses the web prevents access of air between the web layers. Then, the result is a highly carefully finished face of the machine reel. As the member that presses the web, it is preferable to use a brush device. Also, a fragmentary roll and a spreader bar are some further preferred alternative embodiments of the member that presses the web. Owing to the solution in accordance with the present invention, in practice, no waste of web is produced, because of which the solution in accordance with the invention is also economically a significant improvement over prior-art solutions.

The invention will be described in detail with reference to a preferred embodiment of the invention shown in the figures in the accompanying drawing, to which embodiment alone the invention is, however, not supposed to be confined.

DESCRIPTION OF THE PREFERRED EMBODIMENTS

Figure 1:
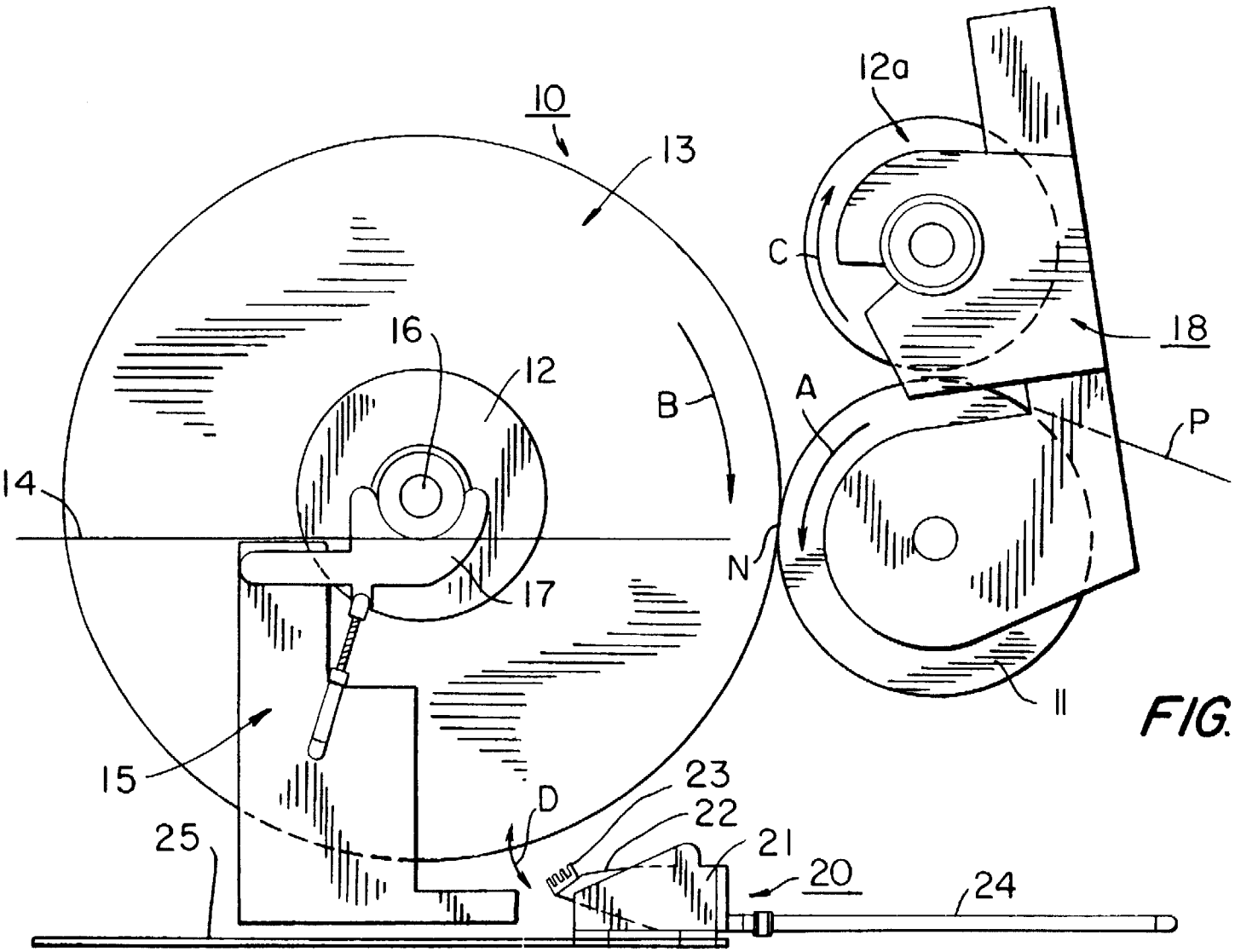
FIG. 1 is a side view of a preferred embodiment of the method and the device in accordance with the invention.

In FIG. 1, the reeling system is denoted generally with the reference numeral 10. In this embodiment, the reeling system 10 comprises a reeling drum 11, which revolves in the direction indicated by the arrow A, and the web P is reeled onto the second roll, i.e. the reel spool 12. The web P is reeled onto the reel spool 12 by the intermediate of the reeling drum 11 through the nip N. The reel drum 12 revolves in the direction indicated by the arrow B. The reel spool 12 is mounted on reeling rails 14, and the reel spool 12 is provided with a centre drive 16 and with a reelspool shifting device 17. The reference numeral 13 represents the machine reel that is being formed, and the reference numeral 15 denotes the reeling carriage, with which the reel-spool shifting device 17 is connected operationally. Further, the reeling system 10 comprises devices for initial reeling 18. The reference numeral **12*a*** denotes an empty reel spool, which revolves in the direction indicated by the arrow C. Such a reeling arrangement is conventional and does not represent any part of the invention proper.

According to the basic realization of the invention, the member 20 that presses the web is brought onto the face of the reel spool 12 that is being filled, i.e. onto the face of the machine reel 13, before the reel 12 that is being completed is shifted to the change position. In the embodiment as shown in FIG. 1, the member 20 that presses the web comprises a carriage 21, a beam 22, and a brush device 23. The carriage 21 is fitted to move along the guides 25. The actuator of the brush device 23 is denoted with the reference numeral 24. In this embodiment, the actuator 24 is a transfer cylinder, which is fitted to displace the carriage 21 along the guides 25.

Figure 2:
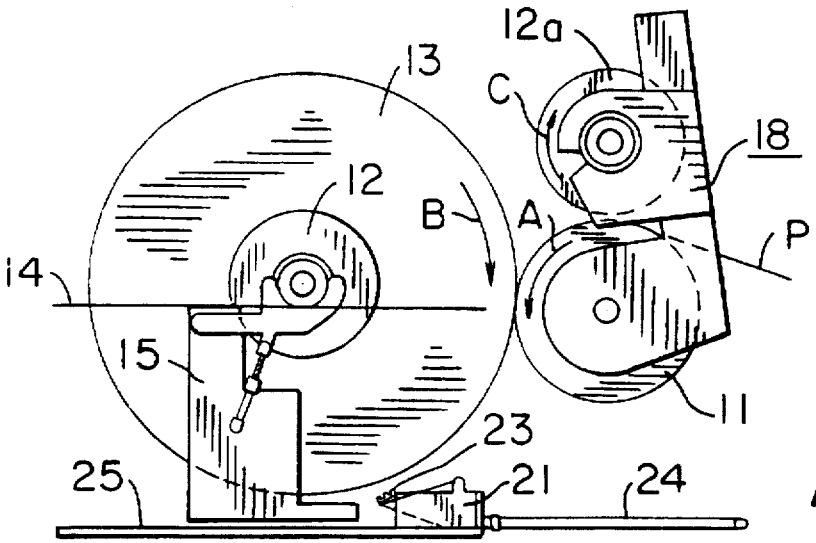
FIG. 2 is a schematic side view of the reeling stage in which the device in accordance with the invention is brought onto the face of the reel that is being completed before the reel that is being completed is shifted to the reel change position.
Figure 3:
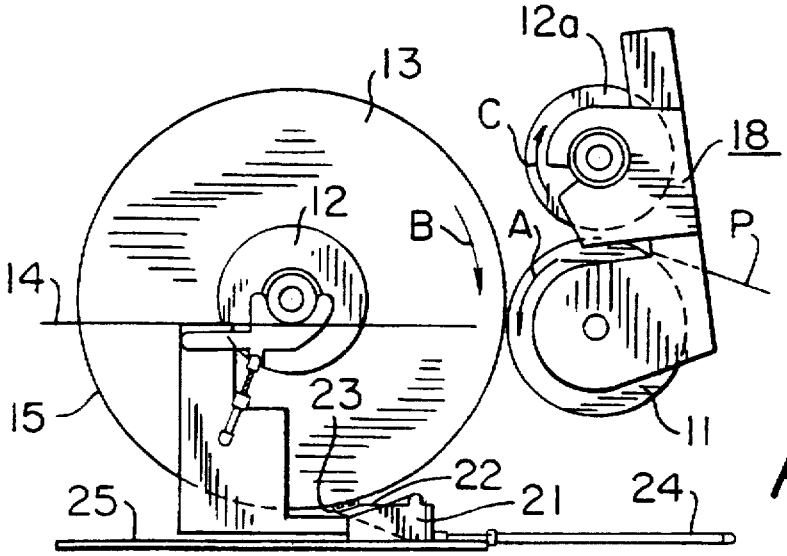
FIG. 3 shows the reeling stage in which the device in accordance with the invention starts finishing the surface layers of the machine reel that is formed in the reeling of the web.
Figure 4:
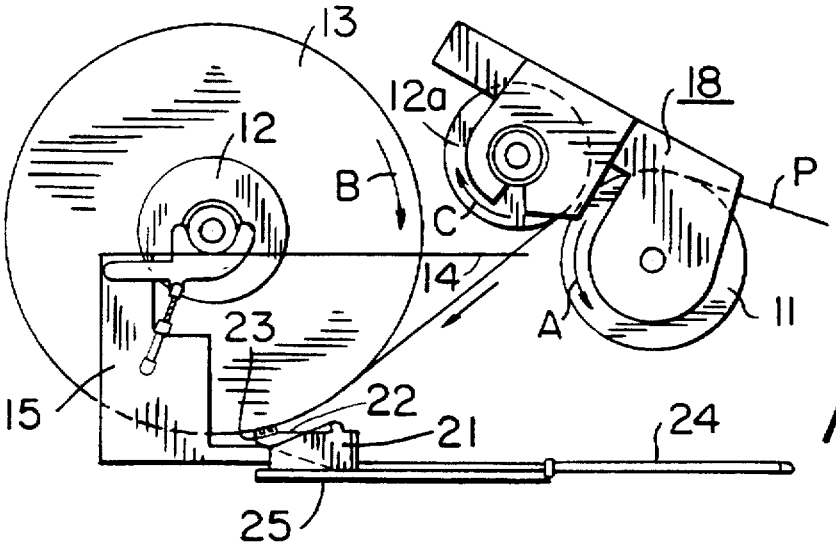
FIG. 4 is a schematic side view of the reeling stage in which the complete machine reel is being shifted to the change position.

As comes out from FIGS. 2 . . . 4, the full reel 12 is shifted to the change position so that, during nip-free reeling, the brush device 23 forms a contact with the web P, which contact prevents access of air between the web layers, and the brush device follows the full reel 12 during its transfer to the change position. In this embodiment, when the carriage 12 collides against the reeling carriage 15, the brush device 23 can rise, and then the brush device 23 can finish the surface layers of the machine reel 13 that is being formed. The brush device 23 is attached pivotally to the frame part 21 of the brush device 23, i.e. to the carriage 21. Of course, the beam 22 of the brush device 23 can be combined with an actuator (not shown) which is fitted to displace the brush device 23 during the reeling of the surface layers to be finished away from the face of the reel 12 that is being completed along such a path of movement D that the brush device 23 maintains a contact of the desired extent with the face of the reel 12 that is being completed.

In the embodiment shown in the figures in the drawing, a brush device 23 has been used as the member 20 that presses the brush. As the member 20 that presses the web, it is equally well possible to use, e.g., a fragmentary roll or a spreader bar.

Above, just one preferred embodiment of the invention has been described, and it is obvious to a person skilled in the art that numerous modifications can be made to said embodiment within the scope of the inventive idea defined in the accompanying patent claims.

We claim:

1. A method for finishing the surface layers of a machine reel formed during reeling of a web in a reeling station in which the reel forms a nip with a reeling drum, comprising the steps of:

providing a pressing member with a brush, while the reel is in nip-defining relationship with the reeling drum in the reeling station displacing the pressing member toward the reel until the brush contacts a face of the reel and presses the web against the face of the reel, and maintaining the brush of the pressing member in pressing contact with the face of the reel while the reel is out of nip-defining relationship with the reeling drum during winding of the finishing surface layers onto the reel to thereby prevent air from entering between the web and the reel as the finishing surface layers are wound onto the reel.

2. The method of claim 1, further comprising the step of moving at least one of the reel and reeling drum from the nip-defining position to a reel change position in which the reel is out of nip-defining relationship with the reeling drum.

3. The method of claim 1, further comprising the step of transferring the reel from the reeling station to a reel change position in which the reel is out of nip-defining relationship with the reeling drum, and wherein the step of maintaining the brush of the pressing member in pressing contact with the face of the reel comprises the step of simultaneously displacing the pressing member during the transfer of the reel from the reeling station to the reel change position.

4. The method of claim 3, further comprising the step of during the reeling of the finishing surface layers when the reel is in the reel change position, shifting the pressing member along a path of movement to maintain the pressing contact of a desired extent between the brush and the face of the reel.

5. An arrangement for finishing the surface layers of a machine reel formed during reeling of a web in a reeling station in which the reel forms a nip with a reeling drum and is transferred from the reeling station to a reel change position, comprising pressing means for pressing the web against the reel, said pressing means comprising a brush, and displacement means coupled to said pressing means for displacing said pressing means to a position adjacent the web running on a face of the reel in which said brush is in contact with the web, said brush being pressed by said pressing means against the face of the reel while the reel is in nip-defining relationship with the reeling drum to thereby press the web against the reel and prevent access of air between the web and the reel, said displacement means and said pressing means being structured and arranged to maintain said brush in pressing contact with the face of the reel while the reel is out of nip-defining relationship with the reeling drum during winding of the finishing surface layers onto the reel to thereby prevent air from entering between the web and the reel as the finishing surface layers are wound onto the reel.

6. The arrangement of claim 5, further comprising guide means for guiding displacement of said pressing means, said displacement means comprising actuators for shifting said pressing means along a path of movement guided by said guide means in order to maintain contact of a desired extent between said brush and the face of the reel during winding of the finishing surface layers onto the reel.

7. The arrangement of claim 5, further comprising guide members for guiding movement of said brush via said displacement means.

8. The arrangement of claim 5, wherein said pressing means further comprise a frame part and pivot means for pivotally attaching said brush to said frame part.

9. The arrangement of claim 5, wherein said displacement means comprise an actuator connected to said pressing means.

10. The arrangement of claim 5, wherein at least one of the reel and reeling drum is moved from the nip-defining position to a reel change position in which the reel is out of nip-defining relationship with the reeling drum.

11. The arrangement of claim 5, wherein the reel is transferred from the reeling station to a reel change position in which the reel is out of nip-defining relationship with the reeling drum, said displacement means being structured and arranged to simultaneously displace said pressing means during the transfer of the reel from the reeling station to the reel change position.

12. A reeling system for reeling a web, comprising a reeling drum, a reel spool initially in nip-defining relationship with said reeling drum, the web being passed through the nip and wound onto the reel spool to form a machine reel around said reel spool which is then in nip-defining relationship with said reeling drum, transfer means for transferring the reel to a reel change position in which the reel is removed from nip-defining relationship with said reeling drum, pressing means for pressing the web against the reel at a location after the nip, said pressing means comprising a brush for directly contacting the web, and displacement means coupled to said pressing means for displacing said pressing means to a position adjacent the web running on a face of the reel in which said brush is in contact with the web, said brush being pressed by said pressing means against the face of the reel while the reel is in nip-defining relationship with the reeling drum to thereby press the web against the reel and prevent access of air between the web and the reel, said displacement means and said pressing means being structured and arranged to maintain said brush in pressing contact with the face of the reel while the reel is out of nip-defining relationship with the reeling drum during winding of the finishing surface layers onto the reel to thereby prevent air from entering between the web and the reel as the finishing surface layers are wound onto the reel.

said displacement means comprising actuators for shifting said pressing means along a path of movement in order to maintain continuous contact of a desired extent between said brush and the face of the reel during reeling of the web onto the reel while the reel is situated in the reel change position.

13. The system of claim 12, further comprising guide members for guiding movement of said brush via said displacement means.

14. The system of claim 12, wherein said brush comprises a frame part and pivot means for pivotally attaching said brush to said frame part.

15. The system of claim 12, wherein said displacement means comprise an actuator connected to said pressing means.

* * * * *